US006363764B1

(12) United States Patent
Bota

(10) Patent No.: US 6,363,764 B1
(45) Date of Patent: Apr. 2, 2002

(54) FORMING APPARATUS FOR DUCT MEMBERS

(75) Inventor: Victor Bota, Brooklyn, OH (US)

(73) Assignee: Cleveland Tool & Machine, Brooklyn, OH (US)

( * ) Notice: Subject to any disclaimer, the term of this patent is extended or adjusted under 35 U.S.C. 154(b) by 0 days.

(21) Appl. No.: 09/507,952

(22) Filed: Feb. 22, 2000

(51) Int. Cl.[7] ..... B21D 3/02

(52) U.S. Cl. ..... 72/117; 72/115; 72/122; 72/124; 72/125

(58) Field of Search ..... 72/112, 113, 115, 72/117, 122, 123, 124, 125

(56) References Cited

U.S. PATENT DOCUMENTS

| | | | | | |
|---|---|---|---|---|---|
| 3,010,506 | A | * | 11/1961 | Bellatorre | 72/124 |
| 3,290,914 | A | * | 12/1966 | Vaill et al. | 72/117 |
| 3,728,059 | A | * | 4/1973 | de Putter | 72/117 |
| 3,815,394 | A | | 6/1974 | Walker | |
| 3,861,184 | A | | 1/1975 | Knudson | |
| 4,198,842 | A | | 4/1980 | Pawlaczyk | |
| 4,210,090 | A | | 7/1980 | Stubbings | |
| 4,399,679 | A | * | 8/1983 | King | 72/117 |
| 4,418,943 | A | | 12/1983 | Ionna | |
| 4,466,641 | A | | 8/1984 | Heilman et al. | |
| 4,881,762 | A | | 11/1989 | Arnoldt | |
| 5,069,484 | A | | 12/1991 | McElroy | |
| 5,090,101 | A | | 2/1992 | Welty | |
| 5,102,253 | A | | 4/1992 | Conti | |
| 5,105,640 | A | | 4/1992 | Moore | |
| 5,189,784 | A | | 3/1993 | Welty | |
| 5,243,750 | A | | 9/1993 | Welty | |
| 5,436,423 | A | | 7/1995 | Welty | |
| 5,450,879 | A | | 9/1995 | Toben | |
| 5,685,345 | A | | 11/1997 | Gieseke et al. | |
| 6,047,584 | A | * | 4/2000 | Filippo | 72/125 |

OTHER PUBLICATIONS

Iowa Precision AEM Gearhead Machines, General Operations Manual, 1st Ed. Jun. 9, 1994.

* cited by examiner

*Primary Examiner*—Ed Tolan
(74) *Attorney, Agent, or Firm*—Hahn, Loeser & Parks, LLP

(57) ABSTRACT

The invention provides an apparatus and method for automated manufacture of connective fittings on a duct member, and particularly a tapered adjustable take off. The connective fitting is generally placed near the inlet of the duct member and comprises a seating bead. The connective fitting can also comprise a seating ring groove for use in conjunction with a seating ring for applications involving connection of the duct member through a duct board. The apparatus for forming a connective fitting on the duct member may include a housing including a work station formed therein. A die associated with the work station is selectively positioned at a predetermined location relative to a work piece positioned in association with the work station. A forming assembly associated with the work station cooperates with the die to selectively form a connective fitting in the work piece at a predetermined angle. A positioning system positions the work piece at a predetermined position for forming the connective fitting, and a control system is provided for at least selective control of the forming assembly associated with the work station, or of other characteristics of the apparatus as desired. A method of manufacturing an adjustable duct member may include the steps of providing a duct member comprising a tube of material having predetermined dimensional characteristics, positioning of said duct member in a work station at a predetermined position relative to a forming assembly of said work station, and forming a seating bead in said duct members at a predetermined angle.

19 Claims, 13 Drawing Sheets

FORMING APPARATUS FOR DUCT MEMBERS

BACKGROUND OF THE INVENTION

The invention is generally directed to an apparatus and method for producing ductwork, and particularly for the manufacture of a seating bead or seating ring groove on an adjustable top take off duct for use in an air handling system.

In general, ductwork is commonly used in forced air heating and air-conditioning systems for buildings and the like, with the ductwork providing a distribution system to various areas of the building from a furnace and/or air-conditioning system. Coupling a round duct to the furnace or main trunk line is commonly provided via a top take off duct member which is positioned in association with the air handling equipment. The top take off provides the outlet for forced air to exit the trunk line or extended plenum for distribution to the registers. Typically, such a top take off comprises a cylindrical fitting associated with a length of cylindrical tubing which is coupled to an outlet opening in a high pressure plenum of the air handling system. The fitting is installed into and fixed in position with respect to the outlet opening in the wall of a trunk line or plenum. To secure the top take off duct member to the outlet opening, the ducts are typically formed with interlocking tabs at least over a portion of the end mating with the trunk line or extended plenum. These tabs typically are formed as full tabs (tabs 360 degrees), or as half tabs (180 degrees). Additionally, in order to install the top take off duct member onto a main trunk line of the metal ductwork, the duct member must also have a seating bead to properly mate to the trunk line. Similarly, in order to install the top take off duct member onto a main trunk line of a fiberglass duct board, the duct member must have a seating ring groove which will allow the installation of a seating ring. The seating ring enables the top take off member to properly mate to the trunk line. The take off duct can then be coupled into cylindrical ductwork which extends to various portions of the building or the like.

Presently, no apparatus or methods exist for automated manufacture of a seating bead or a seating ring groove on a top take off fitting of an air handling system.

SUMMARY OF THE INVENTION

Based upon the foregoing, there is a need for an apparatus and method for automated manufacture of a connective fitting on a top take off duct fitting in the form of a seating bead or a seating ring groove. It is therefore a primary objective of this invention to provide an apparatus and method for manufacturing a seating bead on a top take off duct fitting wherein the seating bead can be used to properly mate the duct member to a main trunk line of a ductwork. Additionally, it is also a primary objective of this invention to provide an apparatus and method for manufacturing a seating ring groove on a top take off duct fitting wherein a seating ring mated to the seating ring groove can be used to properly mate the duct member to a main trunk line through a fiberglass duct board.

Accordingly, the invention provides an apparatus for forming a seating bead or seating ring groove on a top take off duct member for use in an air handling system. The apparatus may comprise a housing including a work station formed therein. A die associated with the work station is selectively positioned at a predetermined location relative to a work piece positioned in association with the work station. A forming assembly associated with the work station cooperates with the die to selectively form a coupling bead or seating ring groove at a predetermined angle in the work place.

Additionally the invention provides a method of automated manufacture of a seating bead on a duct member comprising the steps of: providing a duct member comprising a tube of material having predetermined dimensional characteristics. The duct member is positioned in a work station at a predetermined position relative to a forming assembly of said work station, and a seating bead is formed in the duct member at a predetermined angle.

Other objectives and advantages of the invention will become apparent from the following detailed description of a preferred embodiment taken in conjunction with the drawings.

DETAILED DESCRIPTION OF THE INVENTION

Figure 1:
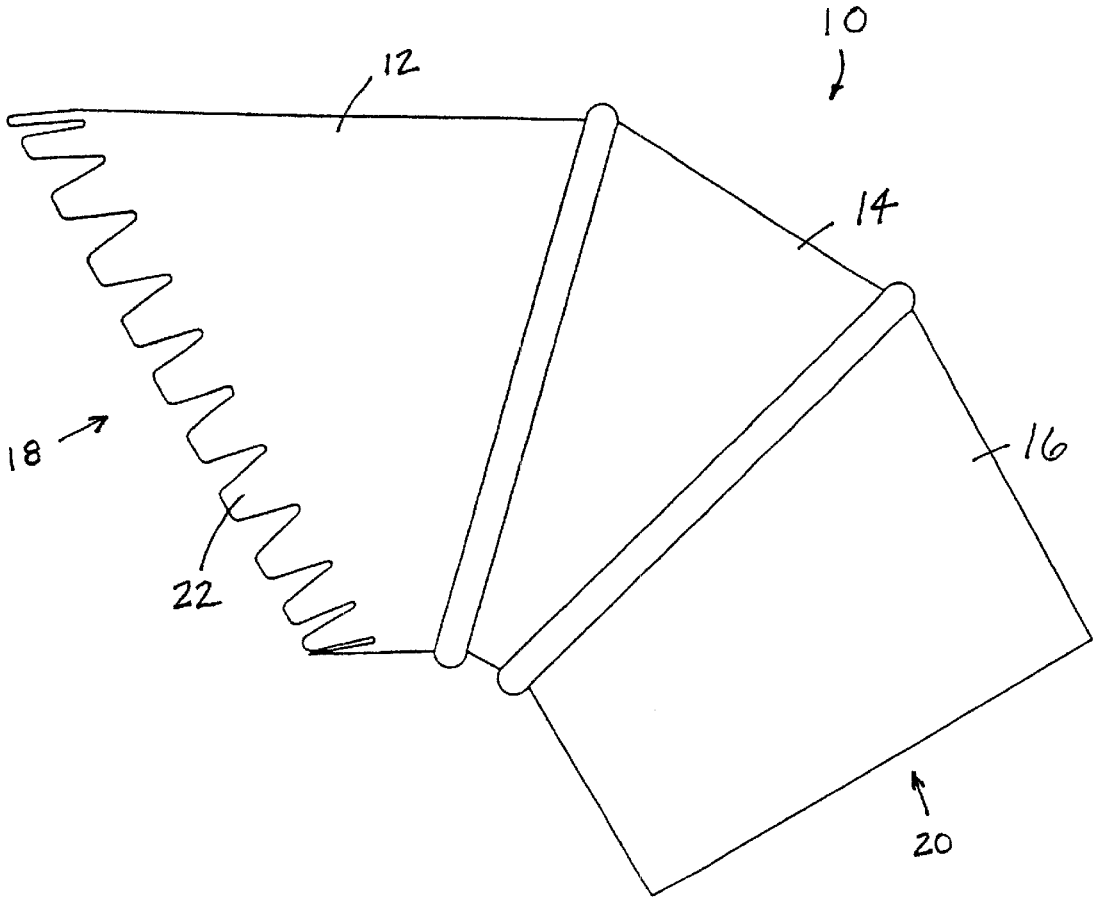
FIG. 1 is a plan view of a full tab adjustable top take off fitting.

A typical adjustable duct member 10 is shown in FIG. 1, wherein the duct member 10 may include three sections or gores 12, 14, and 16. The duct member 10 further includes an inlet opening 18 and an outlet opening 20, being adapted to be coupled between other members in a duct system, or preferably as a top takeoff connected into a plenum associated with the air handling system. To facilitate connection of the duct member 10 in association with a plenum, inlet opening 18 may be provided with a plurality of tabs 22 which may be selectively bent into engagement with an inner wall of the plenum through an opening formed therein. These type connections having tabs extending completely around the circumference of the opening 18 are generally referred to as "full tab" connections. The duct member 10 may also include a taper from the inlet opening 18 to the outlet opening 20, such that each of the gores 12, 14 and 16 become progressively smaller. The tapering of the gores 12, 14 and 16 can provide a significant increase in velocity of air passing through duct 10 from the plenum of the air handling system. The duct member 10 may be produced from a flat blank of material which is rolled such that opposed seams of the blank slightly overlap and are coupled to one another to form the tubular configuration. Coupling at the overlapping seams may be provided in any suitable manner, such as by riveting or the like.

Figure 2:
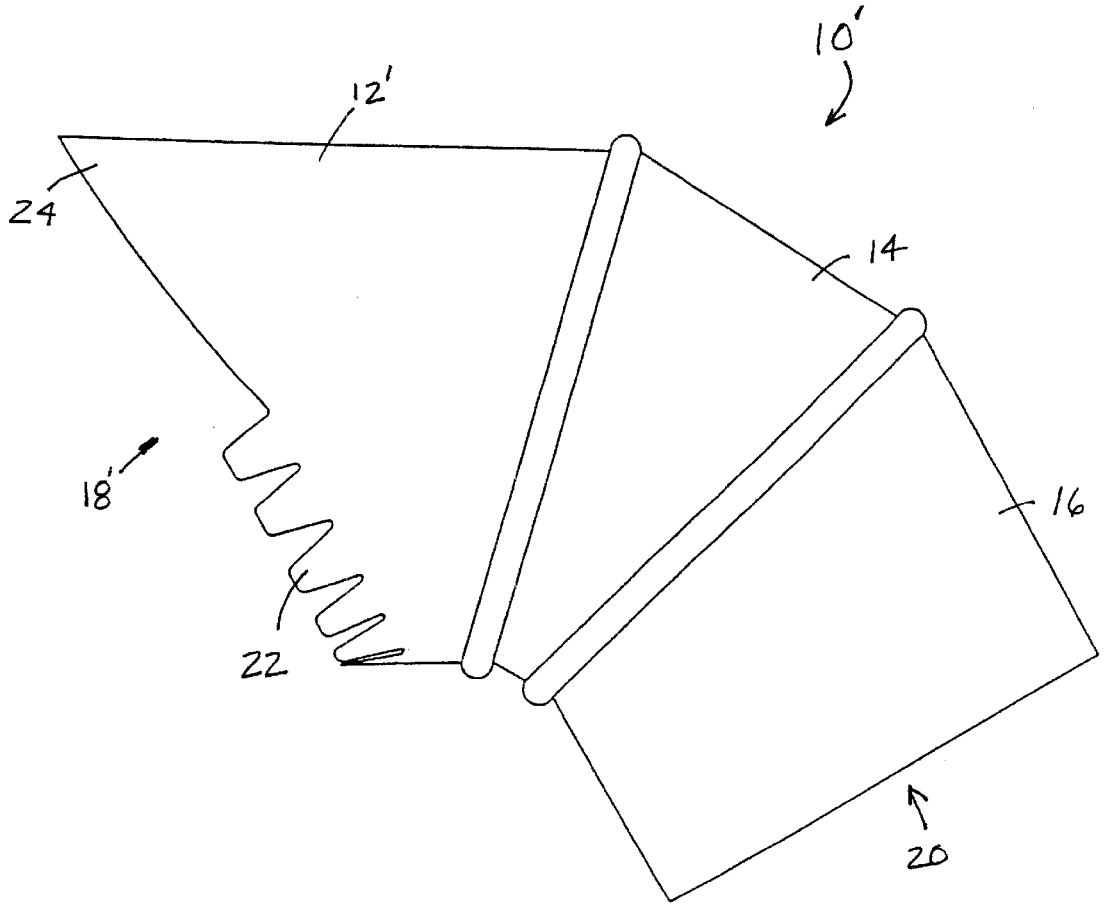
FIG. 2 is a plan view of a half tab adjustable top take off fitting.

Another typical duct member 10' as shown in FIG. 2, varies from the duct member 10 of FIG. 1 in that the inlet opening 18' comprises a plurality of tabs 22 which extend only about a portion of the inlet opening 18', typically representing half of the circumference. This arrangement is commonly referred to as a "half tab" connection. Opposite the tabs 22, the solid edge portion 24 of the gore 12' extends into an opening formed in a plenum of the air handling system, with tabs 22 selectively bet into engagement with an inner wall to secure the duct member in position.

The tubular configurations 10, 10' of the formed blank of material may provide a starting work piece as shown in FIGS. 1 and 2, which may then be operated on by the apparatus and method of the invention. The work piece 10 as shown in FIG. 1 is designed to have a predetermined configuration and dimensional characteristics for use in the apparatus and method of the invention, but any suitable particular dimensional characteristics of the work piece can be accommodated. As an example, the tapered tube as shown in FIG. 1 may have an inlet opening 18 having a diameter of seven inches, while the outlet opening 20 has a diameter of 5.7 inches. The method and apparatus of the present invention may also be used in conjunction with a cylindrical duct as an alternative.

Figure 3:
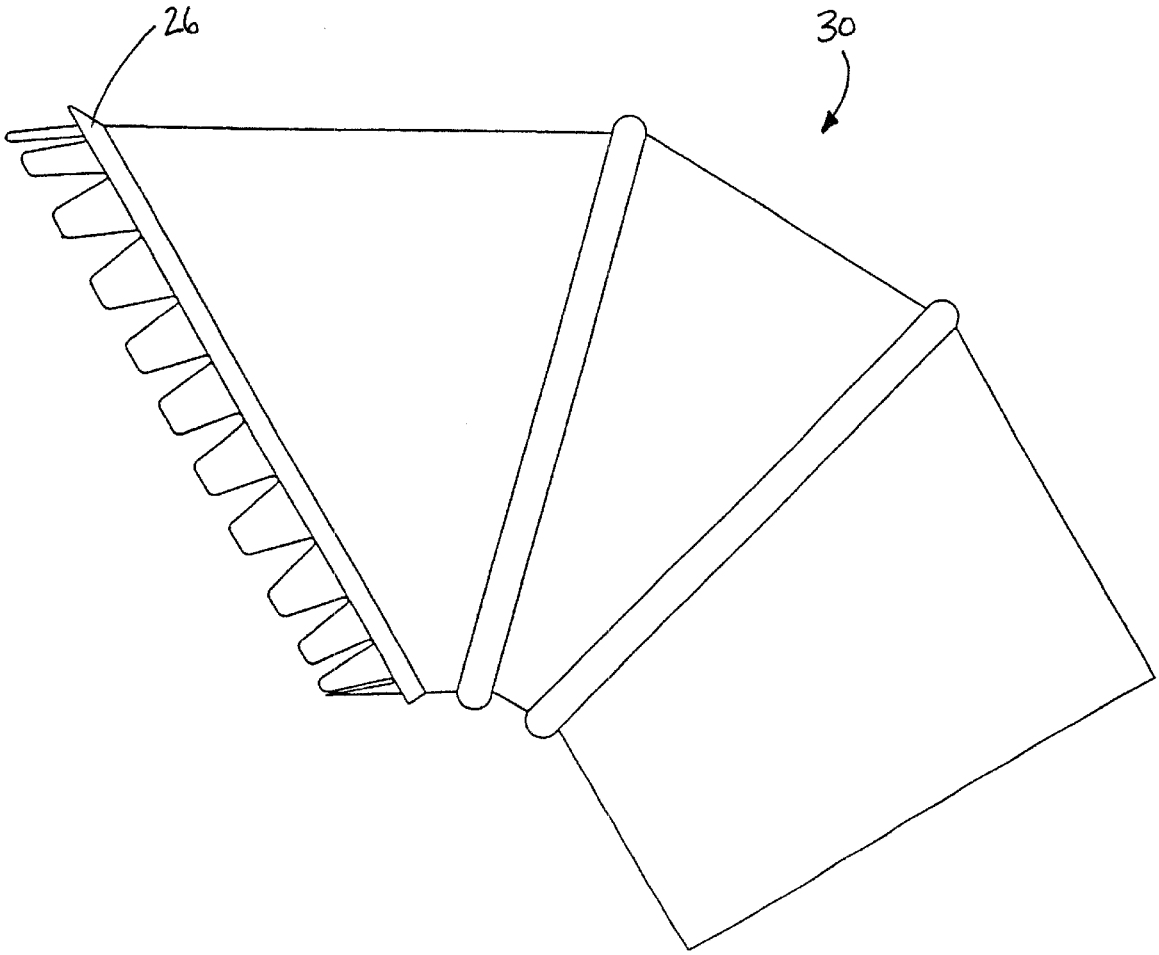
FIG. 3 is a plan view of a full tab adjustable top take off fitting with a seating bead formed thereon which is manufactured according to the present invention.
Figure 4:
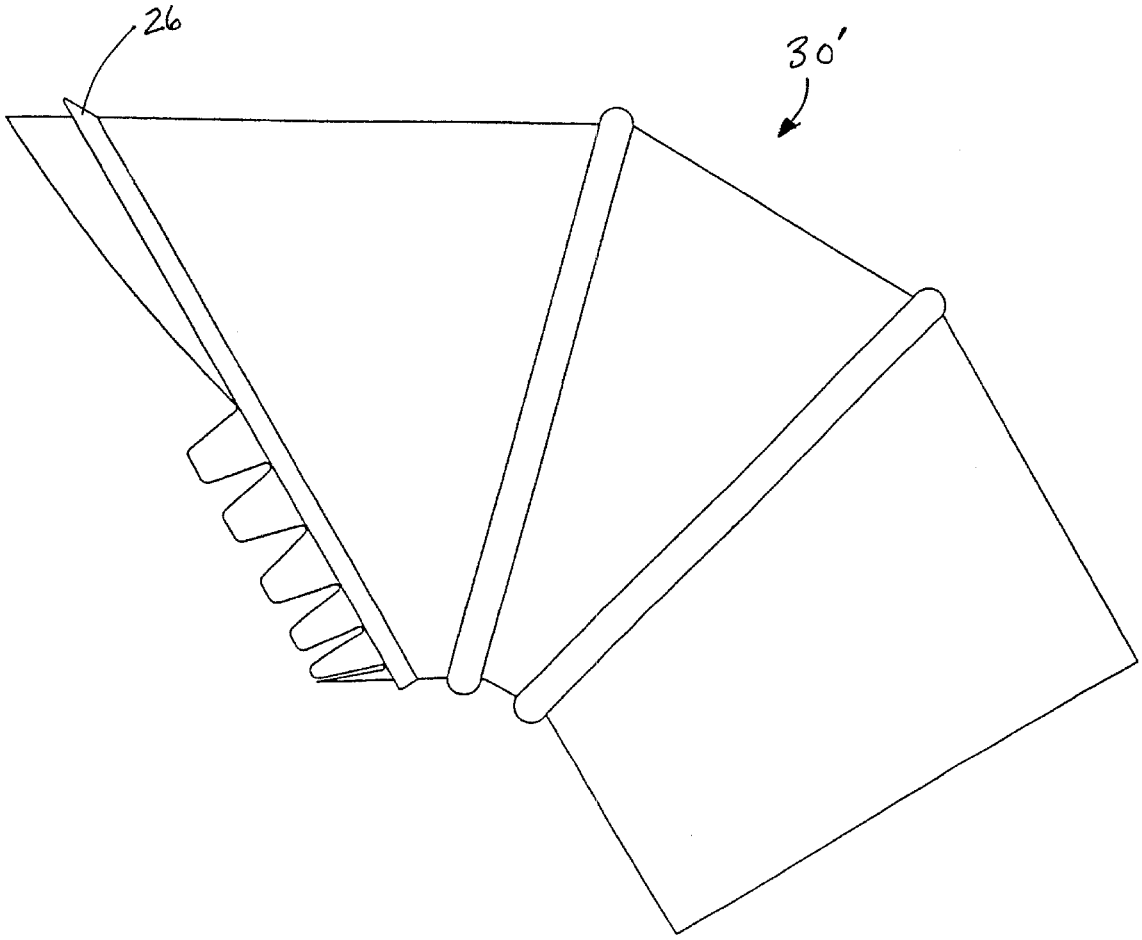
FIG. 4 is a plan view of a half tab adjustable top take off fitting with a seating bead formed thereon which is manufactured according to the present invention.
Figure 5:
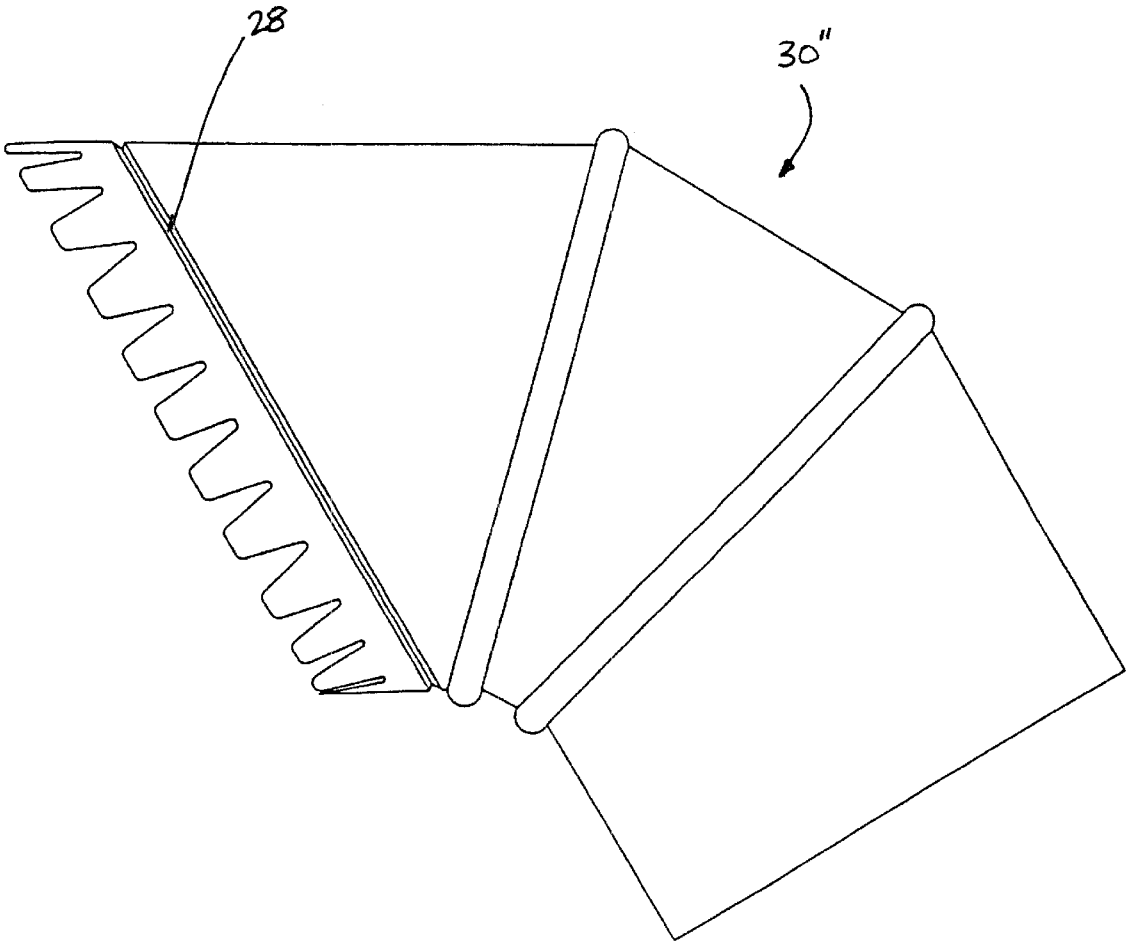
FIG. 5 is a plan view of a full tab adjustable top take off fitting with a seating ring groove formed thereon which is manufactured in accordance with the present invention.

The present invention is directed at producing a connective fitting in the form of a seating bead or a seating ring groove on a duct member work piece 10, 10' to form the duct member to the final preferred form as shown in FIGS. 3–5. Referring now to FIG. 3, a seating bead 26 is shown formed on an adjustable duct member 30 having a full tab configuration. The seating bead 26 provides a register surface which allows the duct member 30 to be properly positioned and securely fastened to a trunk line or plenum of an air handling system. FIG. 4 shows a seating bead 26 formed on a duct member 30' having a half tab configuration. However, the seating bead 26 is not appropriate for situations employing a fiberglass duct board in conjunction with the trunk line. In these applications a seating ring (not shown) is used to mate against the board while the opening of the duct member extends through a hole in the board where it is connected to the trunk line or plenum. The seating ring provides a register surface which allows the adjustable top take off 30 to be properly positioned and securely fastened to the trunk line or plenum. FIG. 5 shows a seating ring groove 28 formed on an a duct member 30" having a full tab configuration. The inside diameter of the seating ring mates with the seating ring groove 28 in a manner securing the seating ring to the member 30". In the same manner, the present invention is also capable of forming a seating ring groove on a duct member having a half tab configuration.

Figure 6:
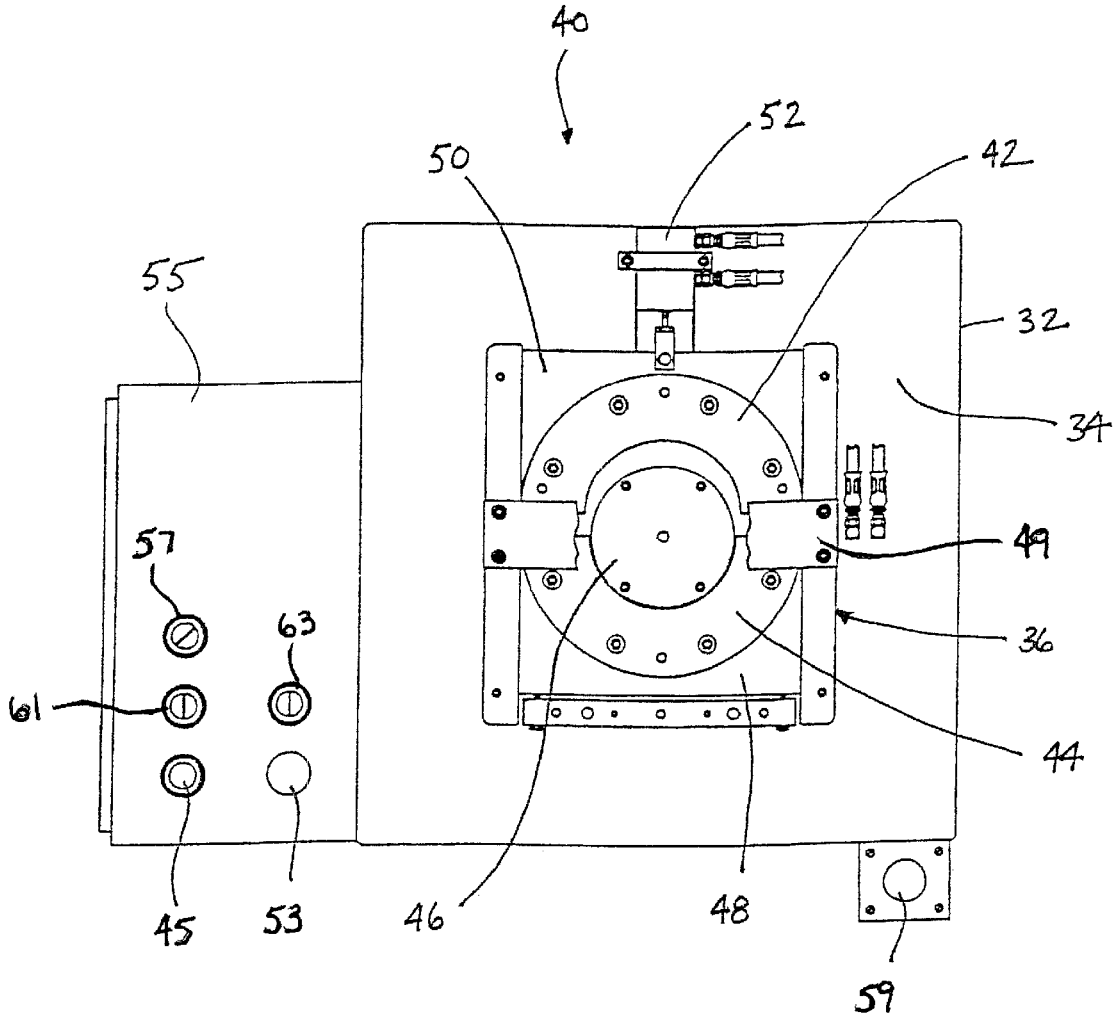
FIGS. 6 and 6A are top view of the forming apparatus of the present invention which identifies the various working parts on the apparatus.
Figure 6A:
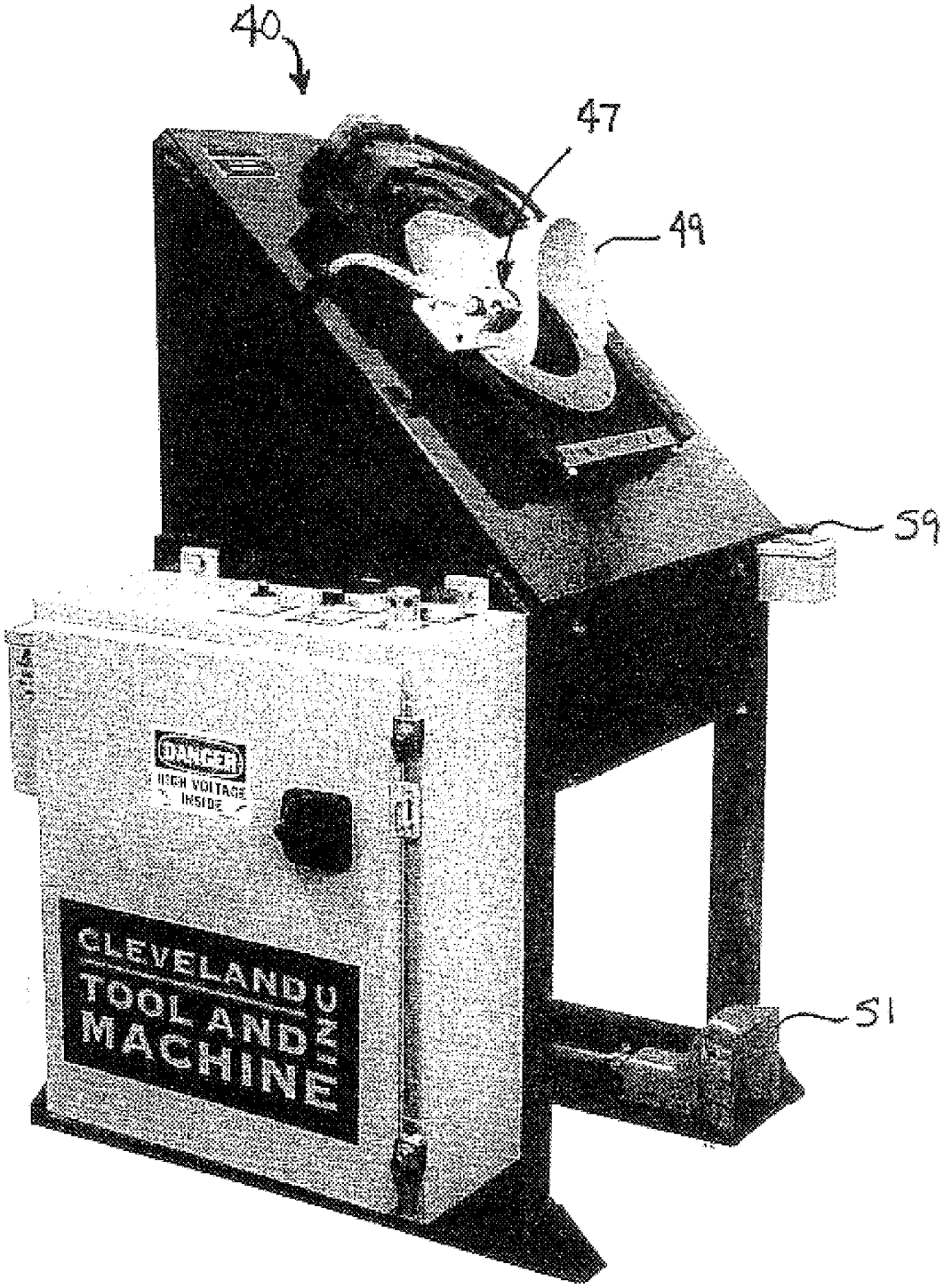
Figure 10:
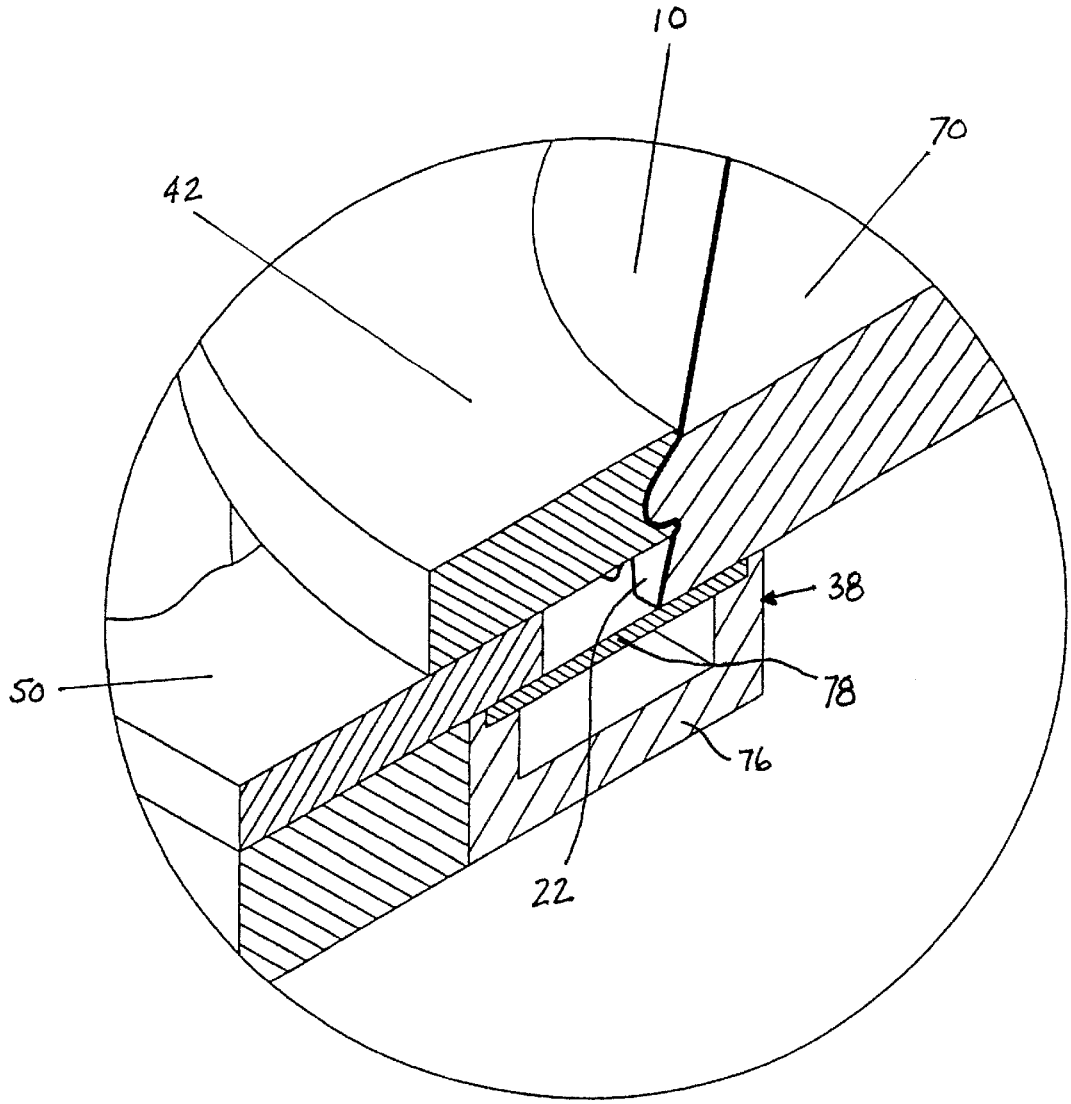
FIG. 10 is an enlarged isometric sectional view showing the work station die along with the forming assembly used for applying the seating bead to the full tab adjustable top take off fitting in accordance with the present invention.
Figure 11:
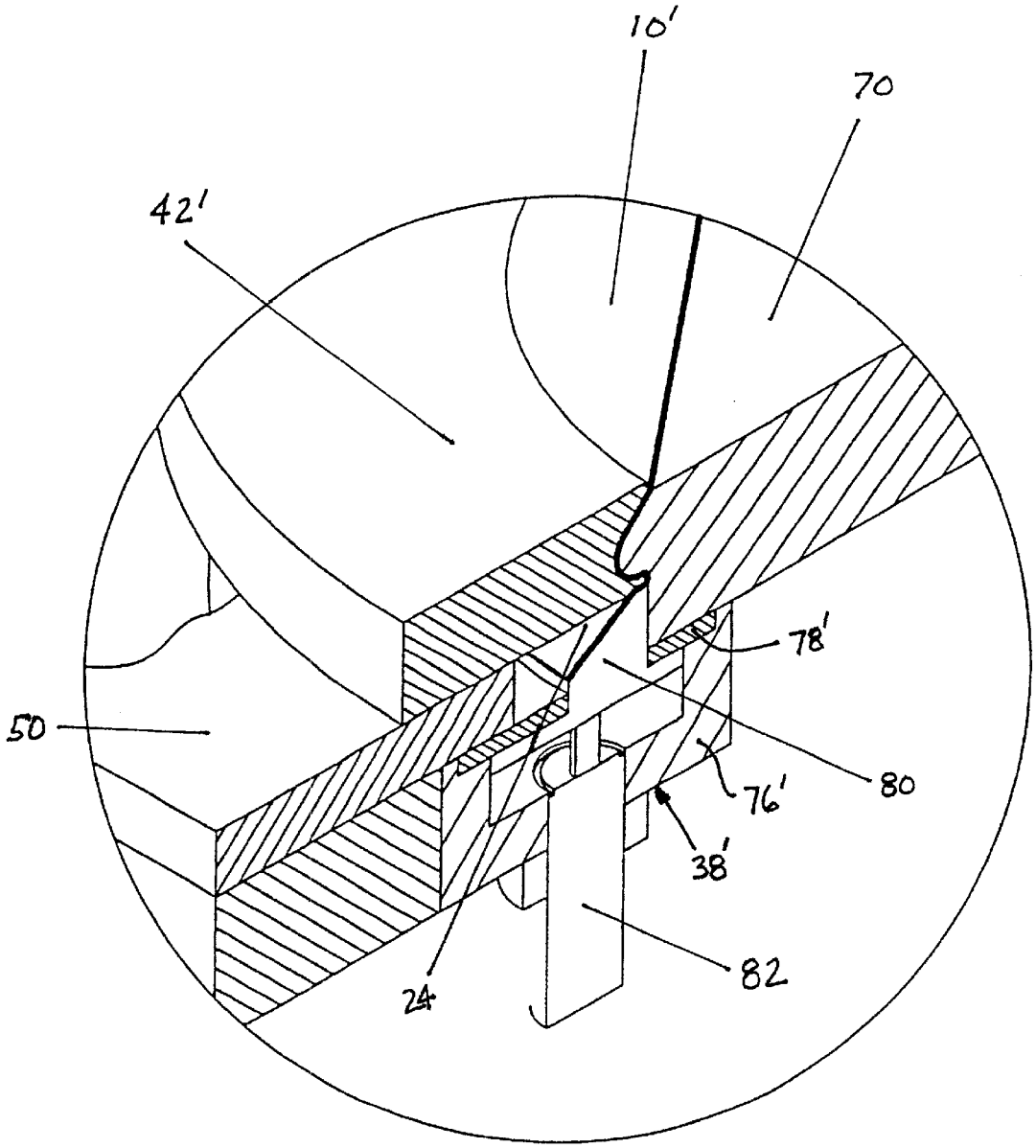
FIG. 11 is an enlarged isometric sectional view showing the work station die along with the forming assembly used for applying the seating bead to the half tab adjustable top take off fitting in accordance with the present invention.
Figure 12:
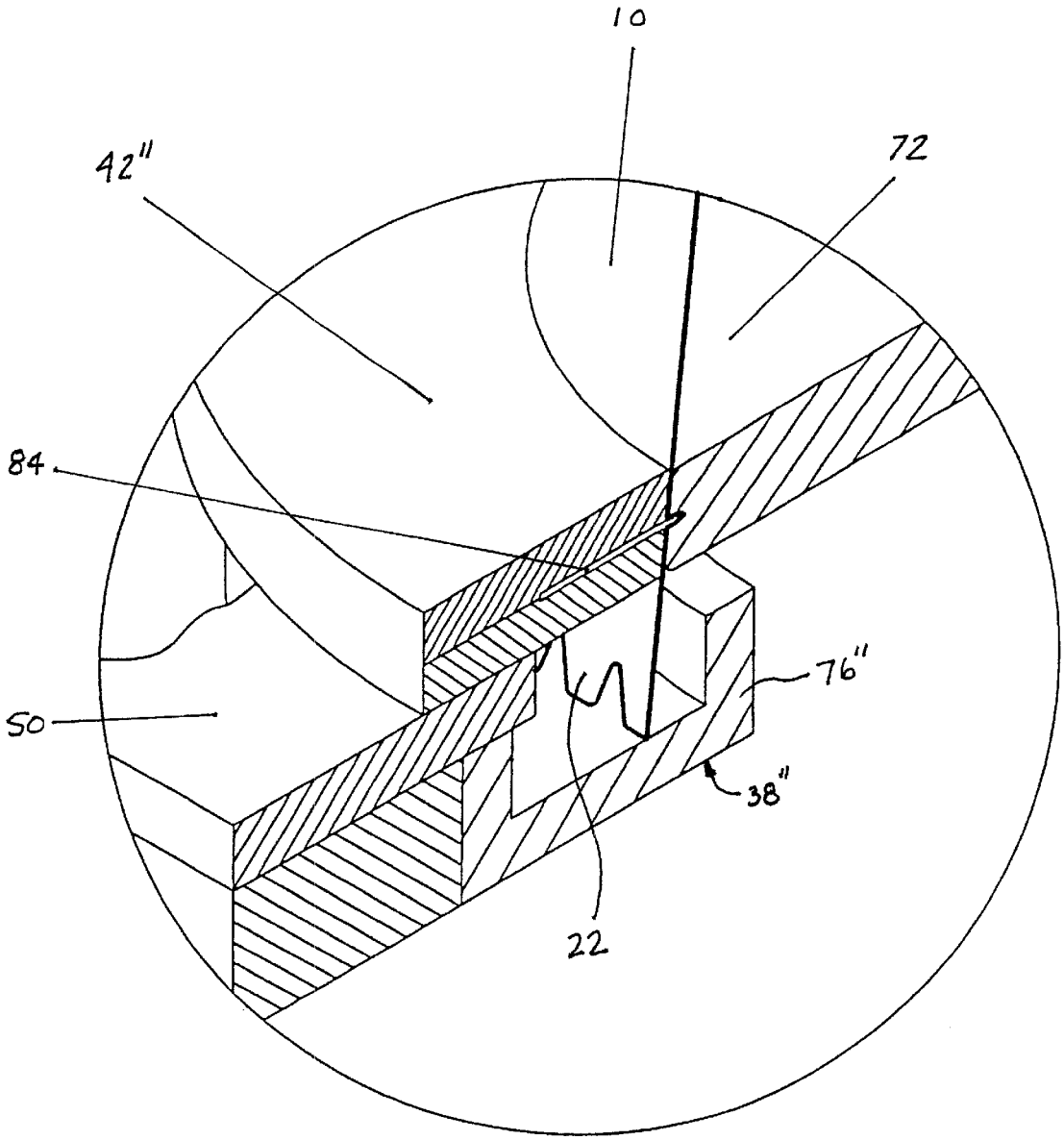
FIG. 12 is an enlarged isometric sectional view showing the work station die along with the forming assembly used for applying the seating ring groove needed to accept the seating ring for fiberglass duct for the full tab adjustable top take off fitting in accordance with the present invention.

The formation of a seating bead 26 or a seating ring groove 28 is accomplished by inserting the inlet 18, 18' end of either a full tab adjustable top take off duct or other duct member 10 or a half tab adjustable top take off 10' into the forming apparatus 40 shown in FIG. 6. The forming apparatus 40 comprises a housing 32 including a upper surface 34 positioned at a predetermined angle, said upper surface 34 having a work station 36 formed therein, wherein said work station 36 includes an upper die 42, a lower die 44, and a forming assembly 46. The dies 42, 44 and the forming assembly 46 each have a different configuration depending on whether a seating bead 26 or a seating ring groove 28 is desired and will be discussed in further detail hereafter. The lower die 44 is fixably attached to a stationary plate 48. The upper die 42 is fixably attached to a sliding plate 50 which is connected to a hydraulic ram 52. When in the open position, as shown in FIG. 6, there is sufficient clearance to insert the inlet end 18, 18' of the adjustable top take off 10, 10' into position over the forming assembly 46 at a predetermined height by contact with a base or height adjustment ring 38 as best shown in FIGS. 10–12. Continuing with FIG. 6, when the forming apparatus is activated, the hydraulic ram 52 moves the top sliding plate 50 along with the upper die 42 toward and into contact with the adjustable top take off 10, 10' thereby clamping it into position between the upper die 42 and the lower die 44. In the preferred embodiment, the hydraulic control system includes a directional valve controlling operation of the clamping action. The forming assembly 46 rotates to form the seating bead 24 or seating ring groove 26 on the adjustable top take off 10, 10'. Referring to FIGS. 6 and 6A, for safety, activation of the forming assembly 46 is initiated in the preferred embodiment by a start switch 45 and an electronic part sensor 47 mounted in association with the safety guard 49 in conjunction with a foot pedal switch 51. In operation the user must have a part located within the guard 49 so as to be detected by sensor 47 while operating the foot pedal switch 51. Upon activation, the machine automatically forms the desired connective fitting. Deactivation of the forming assembly is initiated by a kill switch 53 located on a control panel 55. Alternatively, other safety mechanisms could be used, such as dual activation switches. The control system of the preferred embodiment further allows the mode of operation to be modified for the desired fitting and associated tooling as hereafter described. A mode switch 57 is set either to the set up or run modes, and a set up button 59 used to set the machine to make the desired fitting, being full tab or half tab seating beads or a seating ring groove in the preferred forms. The control system may also include a control 61 for clamping and unclamping the work piece in the machine, and control 63 for forward or reverse rotation of the work piece in the forming operation, or other controls as desired.

Figure 7:
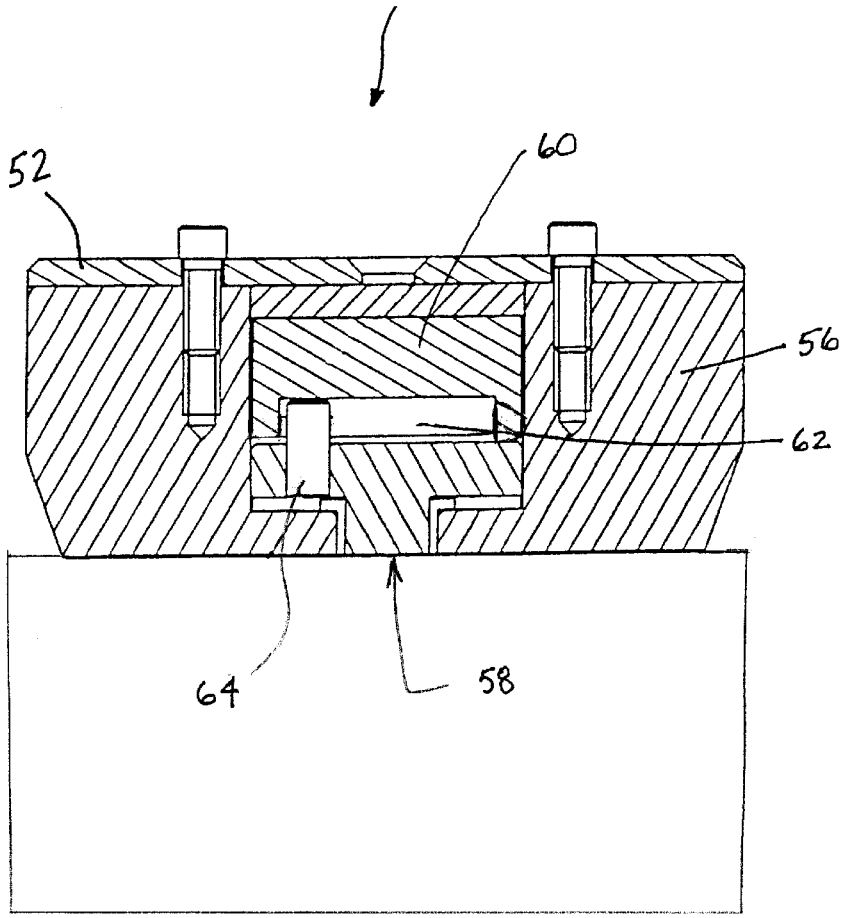
FIGS.7 and 7A are a sectional view of the forming assembly of the apparatus of FIG. 6.
Figure 7A:
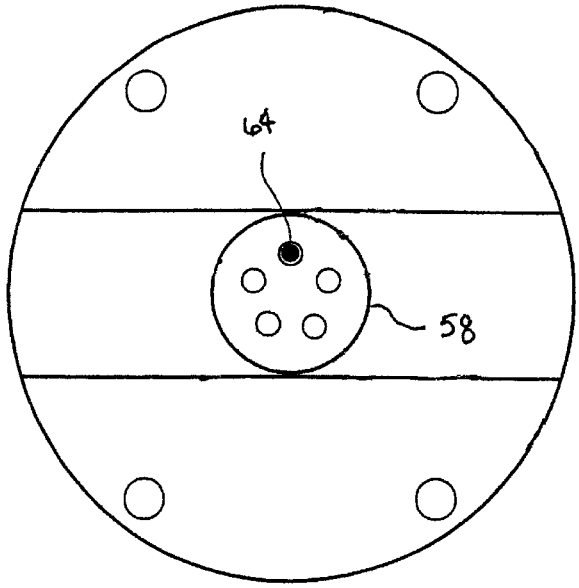
Figure 8:
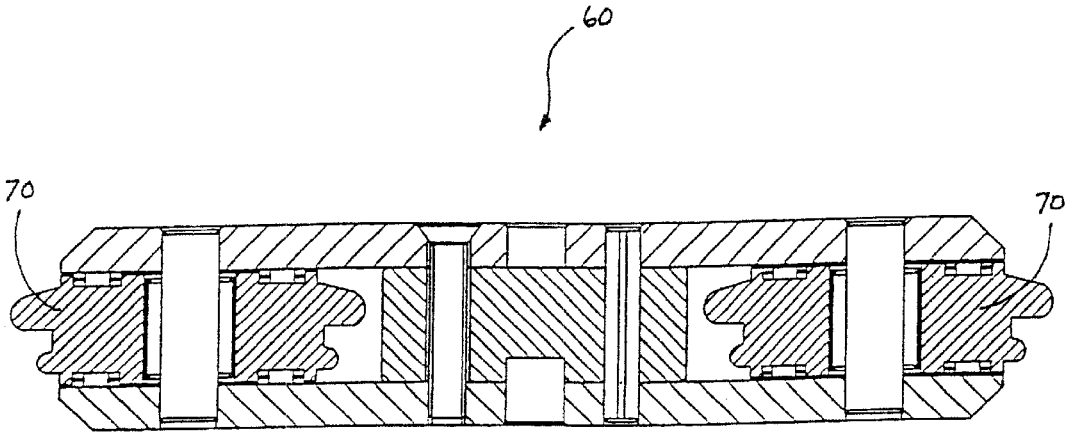
FIGS. 8, 8A and 8B are a sectional view of the forming wheel assembly used to make the seating bead on a duct member.
Figure 8A:
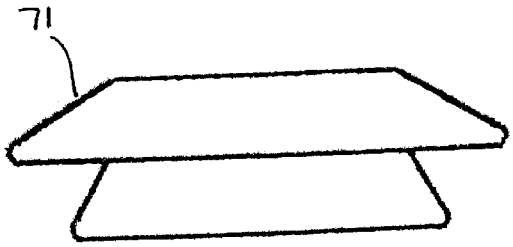
Figure 8B:
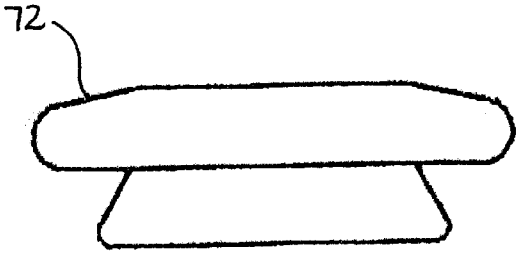
Figure 9:
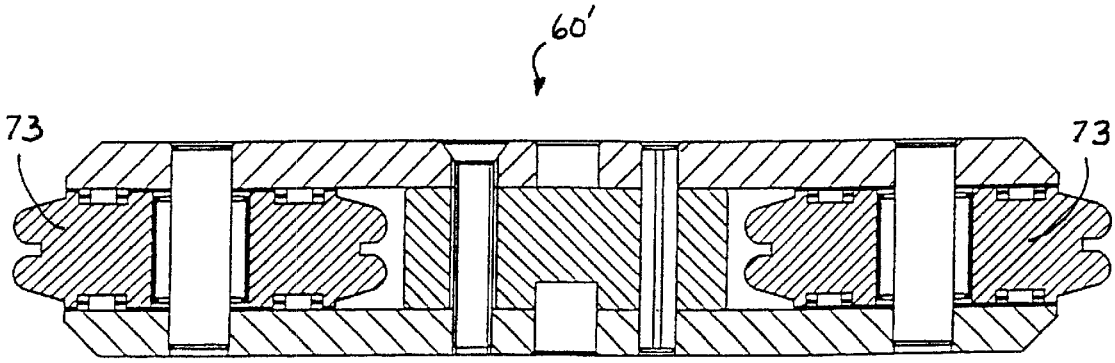
FIG. 9 is a sectional view of the forming wheel assembly used to make a seating ring groove on a duct member for engagement with a duct board seating ring.

Referring now to FIG. 7, the forming assembly 46 comprises a head portion 52 including a support block 54 carrying a rotating working head 56 at a predetermined angle. The rotating head 56 is driven by a drive shaft (not shown) connected to a hydraulic motor (not shown) that is positioned through the center of the support block 54 and is coupled to the rotating working head 56. In the preferred embodiment, the speed of operation of the hydraulic motor is controlled by a proportional valve, allowing the motor to ramp up or down in speed, resulting in less wear on the motor. The rotating working head 56 includes a moveable slide block 60 mounted within a slot 62. The slide block 60 has beading wheels 70 or grooving wheels 72 on either end of the slide block 60, 60' as shown in FIGS. 8, 8A, 8B and 9. Each wheel 70, 71, 72 and 73 is moved back and forth within its associated slide block 60 to perform the beading or grooving operation on alternating cycles as the rotating working head 56 rotates. Referring now back to FIG. 7, the back and forth motion of the slide block 60 within the slot 62 is accomplished by the eccentric drive shaft 58 mounted in the center of the rotating working head 56. The drive shaft (not shown) is driven through an appropriate gear assembly to couple the rotation of the drive shaft to the eccentric drive shaft 58. An off-center pin 64 associated with the eccentric drive shaft 58 is engaged in a slot in the bottom of the slide block 60 which moves the slide block 60 within the slot 62. This allows the beading wheels 70, 71, or 72 or the grooving wheel 73 to extend and engage the interior of the adjustable top take off 10, 10'. This engagement pushes the metal into the top die 42 and bottom die 44 to form the seating bead 26, or seating ring groove 28 on the work piece 10, 10' as will be shown and described in detail below. It is also desired in the preferred embodiment that the mounting of the slide block 60 within the working head 56 is adjustable as shown in FIG. 7A, by repositioning the eccentric pin 64 in a different mounting hole 75 within the eccentric 58. Allowing adjustment of the eccentric 58 allows the user to fine tune the seating bead for the particular work pieces being used, differing material thicknesses or other variables in the work pieces or operation.

Referring now to FIG. 10, the formation of the seating bead 26 is shown in relation to a tabbed portion of a work piece 10. The height at which the seating bead 26 is formed is determined by the base or height adjustment ring 38 which comprises a base channel ring 76 and a top channel cover ring 78. The seating bead 26 is generally formed adjacent to the tabs 22. The top channel cover ring 78 is seated into the base channel ring 76 to set the proper insertion depth of the work piece 10. The sliding plate 50 engages the upper seating bead die 42 against the work piece 10. The beading wheel 70 forms the seating bead 26 by forcing the wall of the work piece 10 into the seating bead cavity of the upper seating bead die 42'.

Referring now to FIG. 11, the formation of the seating bead 26 is shown in relation to a solid edge extending portion 24 of a half-tabbed work piece 10'. The height at which the seating bead 26 is formed is determined by the height adjustment ring 38' which comprises a base channel ring 76' and a top channel cover ring 78'. Although not shown, on the tabbed side of the work piece 10', the height adjustment ring 38' is generally the same as the ring 38 shown in FIG. 10. The difference of the height adjustment ring 38' on the non-tabbed portion side is that a ring 80 is extendable up through an aperture in the top channel cover ring 78' as shown in FIG. 11. The ring 80 is actuated by at least one piston assembly 82 which is mounted through an aperture in the base channel ring 76'. The ring 80 generally extends circumferentially along the non-tabbed portion of the work piece 10'. As before, the work piece 10' is clamped in place when sliding plate 50 engages the upper seating bead die 42' against the work piece 10'. The at least one and preferably three hydraulic lift pistons 82 push the ring 80 against the solid edge extending portion 24. The ring 80 keeps the metal on the half tab adjustable top take off 10' from wrinkling, tearing or jamming the apparatus 40. The beading wheel 70 forms the seating bead 26 by forcing the wall of the work piece 10' into the seating bead cavity of the upper seating bead die 42' due to rotation of the forming assembly 46.

Referring now to FIG. 12, the formation of the seating ring groove 28 is shown in relation to a tabbed portion of a work piece 10. The height at which the seating ring groove 28 is formed is determined by the height adjustment ring 38" which comprises a base channel ring 76". While the seating bead 26 is generally formed adjacent to the tabs 22, the seating ring groove 28 is generally formed a distance away from the tabs 22 so that there is room for the inlet 18 to protrude through the duct board in this application. Accordingly, the inlet 18 is seated into the base channel ring 76" to set the proper insertion depth of the work piece 10. The sliding plate 50 engages the upper seating ring groove die 42" against the work piece 10. The seating ring groove die 42" comprises a seating ring groove extension 84 extending perpendicularly from the seating ring groove die 42". The grooving wheel 72 forms the seating ring groove 28 by forcing the wall of the work piece 10 against a seating ring groove extension 84 and the seating ring groove die 42".

While the above description has been presented with specific relation to a particular embodiment of the invention and method of producing a seating bead or a seating ring groove on a tapered and adjustable duct member, it is to be understood that the claimed invention is not to be limited thereby. It will thus be seen that the objects set forth above, among those made apparent from the preceding description, are obtained. Certain changes may be made without departing from the scope of the invention and the above description is intended to be interpreted as illustrative and not limiting.

What is claimed is:

1. An apparatus for forming a connective fitting on a duct member for use in an air handling system comprising, a housing including an upper surface, said upper surface having a work station formed therein, wherein said work station includes a base for positioning an end of a work piece at a predetermined distance below said upper surface, a die positioned within said work station is supported in association with said upper surface and selectively positioned at a predetermined location relative to said work piece, a forming assembly positioned within said work station cooperates with said die to selectively form a connective fitting on said work piece, and a control system for at least selective control of said forming assembly associated with said working station.

2. The apparatus of claim 1, wherein said connective fitting is a seating bead.

3. The apparatus of claim 1, wherein said connective fitting is a seating ring groove.

4. The apparatus of claim 1, wherein said forming assembly comprises a rotating working head comprising at least one forming wheel fixably attached to a slide block housed within said rotating working head, said at least one forming wheel configured complimentary to said forming die to produce a connective fitting in said workpiece.

5. The apparatus of claim 4, wherein rotation of said drive shaft head causes said pin to engage said slide block and force said at least one forming wheel to engage said workpiece.

6. The apparatus of claim 1, wherein said die comprises a first die member and a second die member opposing said first die member.

7. The apparatus of claim 6, wherein said first and second die members are selectively moveable against said workpiece to clamp said workpiece into a predetermined position.

8. The apparatus of claim 1, wherein said workpiece is a tapered top take-off duct member.

9. The apparatus of claim 8, wherein said tapered top take-off duct member has a half-tab formed at an opening end of said tapered top take-off duct member.

10. The apparatus of claim 8, wherein said tapered top take-off duct member has a full-tab formed at an opening end of said tapered top take-off duct member.

11. The apparatus of claim 1 further comprising a workpiece sensor to detect when said work piece is properly positioned within said workstation.

12. The apparatus of claim 11, wherein said workpiece sensor is housed in a safety guard protruding upward from said upper surface.

13. The apparatus of claim 9 wherein said base member comprises a semi-circular ring which is selectively moveable to engage and support a solid edge extending portion of said half tabbed tapered top take-off duct member during forming operation.

14. The apparatus of claim 1, wherein the forming assembly comprises at least one forming wheel wherein the radial movement of said at least one forming wheel is controlled at least in part by an eccentrically positioned pin placed in one of a plurality of apertures in a drive shaft head associated with said forming assembly.

15. The apparatus of claim 14, wherein each aperture is positioned at different distances from the center of said drive shaft head.

16. An apparatus for forming a connective fitting on a duct member for use in an air handling system comprising, a housing comprising an upper surface positioned at a predetermined angle, said upper surface having a work station formed therein, wherein said work station includes a base for positioning of said duct member at a predetermined depth with respect to said upper surface, a first semi-circular die member and a second semi-circular die member, at least one of said die members moveable against the other to form a circular die and to clamp said duct member in a manner preventing rotation of said duct member, a forming assembly associated with said work station which comprises at least two forming wheels housed in a rotating working head, said at least two forming wheels radially adjustable to cooperate with said die to selectively form a connective fitting in said duct member at a predetermined location, and a control system for at least selective control of said forming assembly associated with said work station, wherein said forming assembly comprises an eccentrically positioned pin which controls the radial movement of said at least two forming wheels.

17. The apparatus of claim 16, wherein said eccentric pin is placed in one of a plurality of apertures in a drive shaft head positioned within said rotating working head, wherein each aperture is positioned at different distances from the center of said drive shaft head.

18. An apparatus for forming a connective fitting on a duct member for use in an air handling system comprising:

a housing including an upper surface, said upper surface having a work station formed therein, wherein said work station includes a base for positioning of a duct member at a predetermined position with respect to said upper surface, a die positioned within said work station is supported in association with said upper surface and selectively positioned at a predetermined location relative to said duct member, a forming assembly associated with said work station cooperates with said die to selectively form a connective fitting on said duct member, a control system for at least selective control of said forming assembly associated with said working station, and wherein said base member comprises a semi-circular ring which is selectively moveable to engage and support at least an interior portion of said duct member.

19. The apparatus of claim 18, wherein said connective fitting is a seating ring groove.

* * * * *